US007901230B1

(12) United States Patent
Lo

(10) Patent No.: US 7,901,230 B1
(45) Date of Patent: Mar. 8, 2011

(54) POWER PLUG

(76) Inventor: Ding-Ea Lo, Taipei (TW)

( * ) Notice: Subject to any disclaimer, the term of this patent is extended or adjusted under 35 U.S.C. 154(b) by 0 days.

(21) Appl. No.: 12/658,004

(22) Filed: Feb. 1, 2010

(51) Int. Cl.
*H01R 29/00* (2006.01)

(52) U.S. Cl. ..... 439/188

(58) Field of Classification Search ..... 439/188, 439/345, 346; 200/51.09
See application file for complete search history.

(56) References Cited

U.S. PATENT DOCUMENTS 3,838,385 A * 9/1974 Bloomingdale ..... 439/259
4,230,386 A * 10/1980 Farnworth et al. ..... 439/188
4,623,209 A * 11/1986 Mangone ..... 439/370
5,277,602 A * 1/1994 Yi ..... 439/138
6,310,306 B1 * 10/2001 Norling ..... 200/51.09
7,001,196 B1 * 2/2006 Huang ..... 439/320
2009/0186504 A1 * 7/2009 Santos ..... 439/188
* cited by examiner

*Primary Examiner* — Gary F. Paumen
(74) *Attorney, Agent, or Firm* — William E. Pelton, Esq.; Cooper & Dunham LLP

(57) ABSTRACT

A power plug has a housing, two blades, a slider mounted through the housing, and a cylindrical resilient member mounted inside the housing. When the plug is unplugged, the ends of the blades inside the housing are not contacted with two spring leaves inside the housing. When the plug is plugged in a power socket, the slider abuts against the socket, moves into the housing and compresses the resilient member to become an oval shape. The distorted resilient member pushes the two blades inside the chamber to pivot to and contact with the respective spring leaves, and the ends of the two blades outside the chamber mutually close up to hold the power socket, preventing accidental release of the plug. When the power plug is unplugged, the elastic force released by the resilient member pushes the housing to move away from the power socket, making the plug easily unplugged.

8 Claims, 5 Drawing Sheets

POWER PLUG

BACKGROUND OF THE INVENTION

1. Field of the Invention

The present invention is related to a plug, and more particularly to a power plug of an electrical appliance.

2. Description of the Related Art

To electrically connect an electrical appliance to a power socket a power plug is inserted into the power socket and blades of the power plug are held by conductive strips of the power sockets. When new, the power socket holds the power plug firmly, therefore, to remove the plug the plug is held in one hand. With use, the holding force of the conductive strips gradually reduces and the power plug becomes easily removable, even by a slight touch so contributing to both electrocution and fire risks and endangering young children.

For improved safety locking means have been used to secure the plug. The locking means uses screws to connect the power plug and socket. However, the screw must then be unscrewed before removing the plug, which is both time-consuming and laborious. Therefore, an easy-to-unplug locking means is required.

SUMMARY OF THE INVENTION

An objective of the present invention is to provide a lockable power plug having an easy release system.

To achieve the foregoing objective, the power plug has a housing, a slider, a resilient member, two spring leaves, two blades and two restorable clips.

The housing has an upper case, a lower case, a stopper, a wire inlet and a slider opening. The lower case is mounted on the upper case to define a chamber. The stopper is mounted inside the chamber. The wire inlet is formed through a first side of the housing, communicates with the chamber, and abuts the stopper. The slider opening is formed through a second side of the housing opposite to the first side of the housing and communicates with the chamber. The slider is mounted through the slider opening and has one end and a limit plate. The end of the slider is received in the chamber. The limit plate is formed on the end of the slider and is larger than the slide opening. The resilient member is cylindrical, is securely mounted on the limit plate, and is located inside the chamber of the housing and between the stopper of the housing and the limit plate of the slider. The two spring leaves are respectively mounted on two opposite positions of the lower case located inside the chamber and abutting the stopper. The two blades are pivotally mounted to the housing. One end of each blade is located inside the chamber and between the corresponding spring leaf and the resilient member. The two restorable clips are respectively mounted on two opposite positions of the lower case and respectively abut against the two blades to keep one ends of the two blades inside the chamber pivoting toward the resilient member.

When the power plug of the present invention is plugged in a power socket, the slider abuts against the power socket, moves into the chamber and compresses the resilient member together with the stopper inside the chamber. The resilient member is distorted to have an oval form. Two protruded sides of the oval-like resilient member respectively push the two blades so that the ends of the blades inside the chamber are pivoted to and contact with the corresponding spring leaves. Therefore, power can be conducted to the electric wire through the blades and the spring leaves. The ends of the two blades outside the chamber are also pivoted to close up to hold the power socket and prevent accidental removal of the power plug.

When the power plug is unplugged, the elastic force released by the resilient member upon recovering to its original shape acts on the stopper inside the chamber so that the housing moves away from the power socket. Accordingly, the present invention has an effective lock that is easy to release.

DETAILED DESCRIPTION OF THE INVENTION

Figure 1:
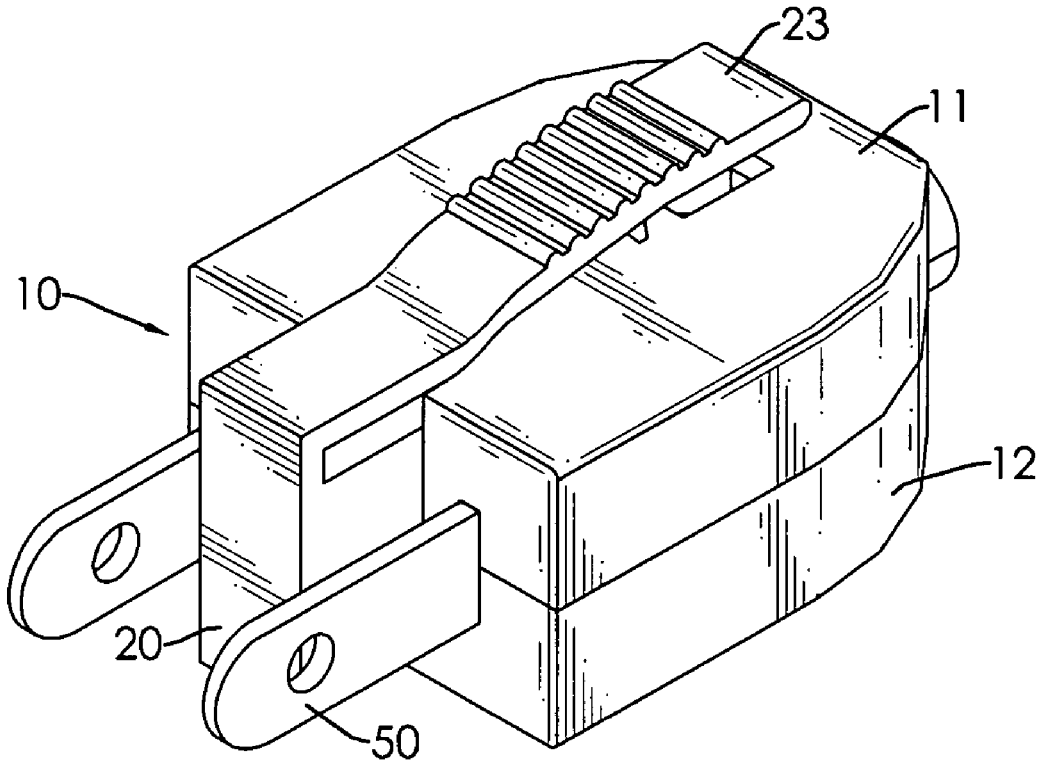
FIG. 1 is a perspective view of a power plug in accordance with the present invention.
Figure 2:
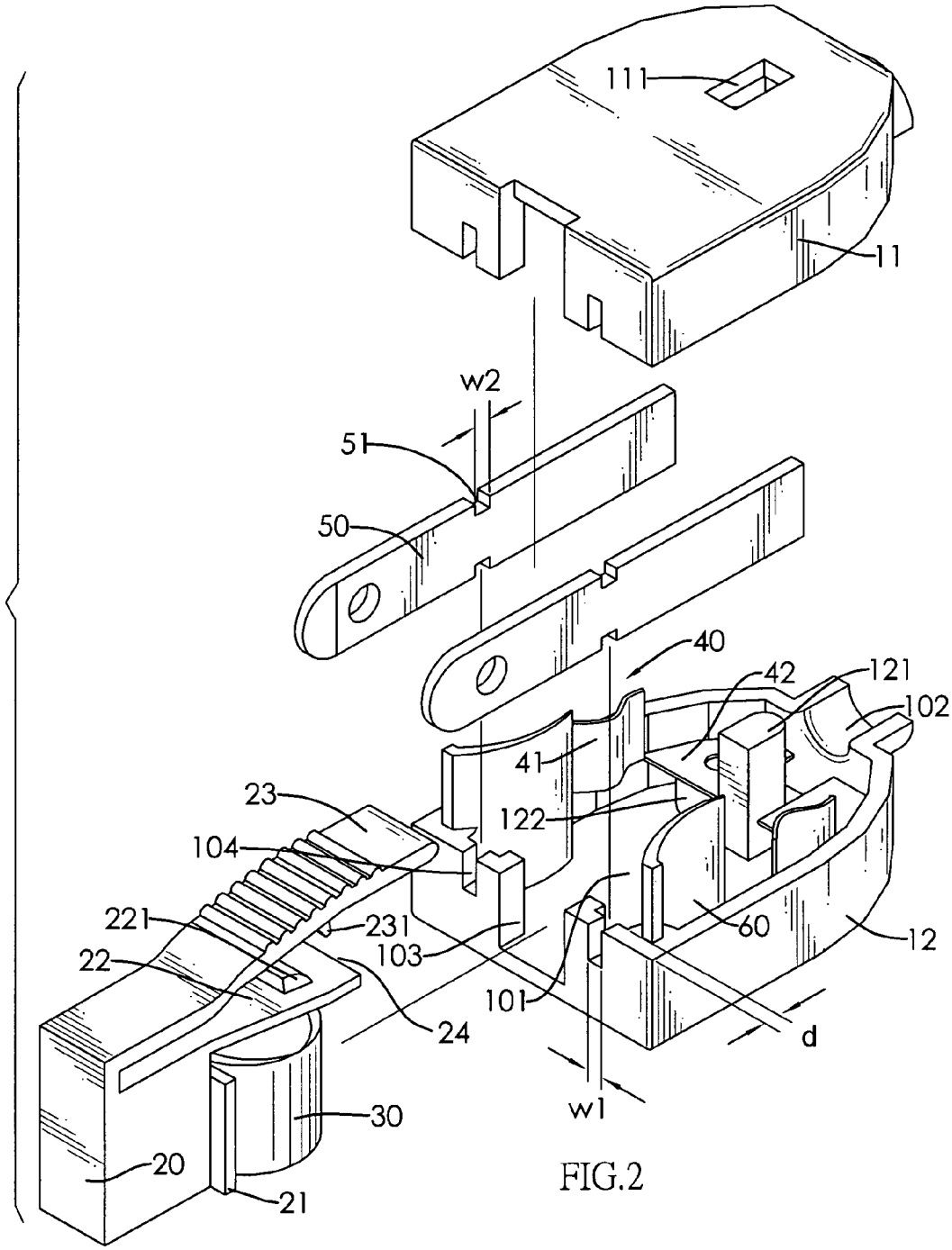
FIG. 2 is an exploded perspective view of the power plug in FIG. 1.
Figure 3:
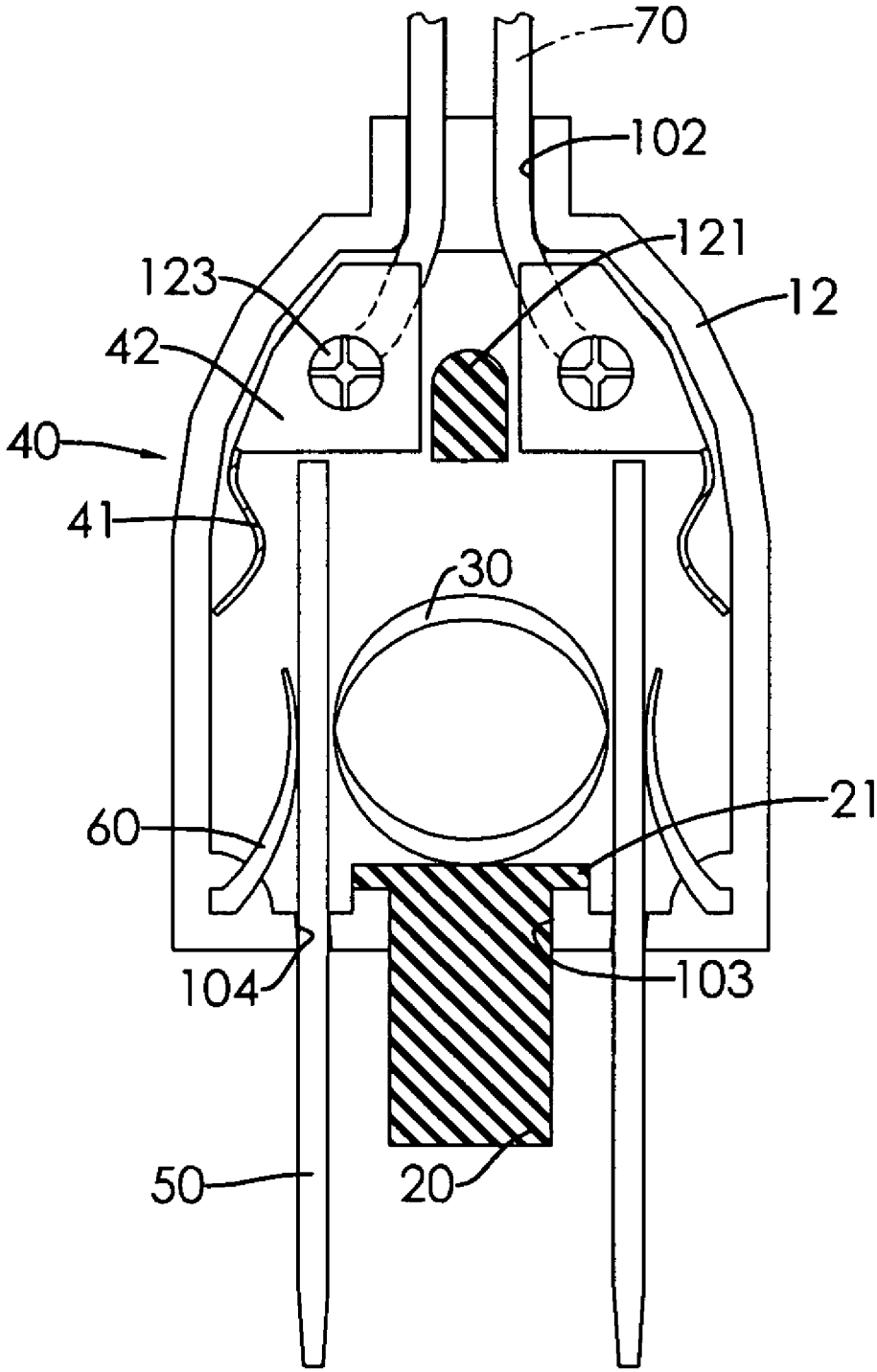
FIG. 3 is a cross-sectional view of the power plug in FIG. 1.

With reference to FIGS. 1 to 3, a power plug in accordance with the present invention has a housing (10), a slider (20), a resilient member (30), two spring leaves (40), two blades (50) and two restorable clips (60).

The housing (10) has an upper case (11), a lower case (12), a chamber (101), a wire inlet (102), a slider opening (103), and two blade slots (104). The upper case (11) is oppositely mounted on the lower case (12) to define a chamber (101). The wire inlet (102) is formed through a first side of the housing (10). The slider opening (103) is formed through a second side of the housing (10) opposite to the first side. Each blade slot (104) is formed through the second end and located beside the slider opening (103). The upper case (11) has an engagement slot (111) formed through a top of the upper case (11). The lower case (12) has a stopper (121) and two screw blocks (122). The stopper (121) and the two screw blocks (122) are mounted on the lower case (12) and abut the wire inlet (102). The stopper (121) is mounted between the two screw blocks (122). The wire inlet (102), the slider opening (103), the two blade slots (104) and the engagement slot (111) communicate with the chamber (101).

Figure 5:
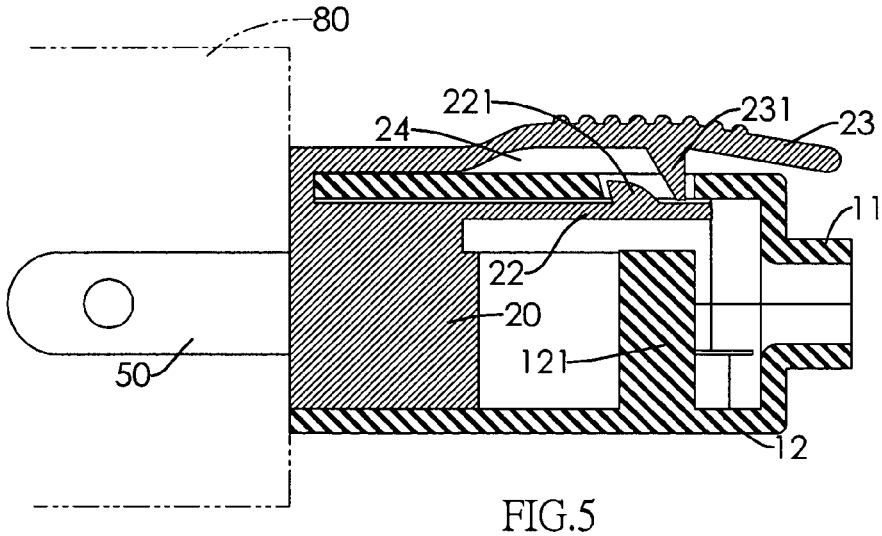
FIG. 5 is a second cross-sectional view of the power plug in accordance with the present invention when the power plug is inserted into a power socket.

With reference to FIG. 5, the slider (20) is mounted through the slider opening (103) of the housing (10), and one end of the slider (20) is received inside the chamber (101) of the housing (10). The slider (20) has a limit plate (21), an engagement tongue (22), an engagement block (221), a release tongue (23), an urging finger (231) and a mouth (24). The limit plate (21) is formed on the end of the slider (20) inside the chamber (101) and is larger than the slider opening (103) to prevent the slider (20) from coming off the housing (10). The engagement tongue (22) is formed on and extends from the end of the slider (20) inside the chamber (101) to the second side of the housing (10). The engagement block (221) is formed on a top of the engagement tongue (22). The release tongue (23) is formed on and extends from one end of the slider (20) outside the chamber (101) to the second side of the housing (10) and is located outside the housing (10). The urging finger (231) is formed on a bottom of the release tongue (23). The mouth (24) is formed in the slider (20) and between the engagement tongue (22) and the release tongue (23). When the slider (20) is moved into the chamber (101), the top of the upper case (11) slides in the mouth (24) and the engagement block (221) and engages with the engagement slot (111) of the upper case (11). When the engagement block (221) engages with the engagement slot (111), the urging finger (231) is located directly above the engagement slot (111).

The resilient member (30) is cylindrical, is mounted inside the chamber (101) of the housing (10) between the stopper (121) and the limit plate (21) of the slider (20). A periphery of the resilient member (30) is securely mounted on the limit plate (21).

The two spring leaves (40) are respectively mounted on two opposite positions of the lower case (12) located inside the chamber (101) and abutting the stopper (121). Each spring leaf (40) has a contact piece (41) and a fixing piece (42). The fixing piece (42) is connected with a neighboring contact piece (41), is located above a screw block (122) and is fastened on the screw block (122) by a screw (123).

The two blades (50) are respectively mounted in the two blade slots (104) and can be slightly pivoted. One end of each blade (50) inside the chamber (101) of the housing (10) is located between the resilient member (30) and the contact piece (41) of a corresponding spring leaf (40). Each blade (50) has two positioning channels (51), and each positioning channel (51) abuts against the second side of the housing (10) and an inner wall of the housing (10) opposite to the second side. The thickness of the blades (50) is less than a width (w1) of the corresponding blade slot (104) and a width (w2) of each positioning channel (51) is more than a depth (d) of the corresponding blade slot (104) so that the blades (50) can be pivoted relative to the respective blade slots (104) without coming off the housing (10).

The two restorable clips (60) are mounted inside the chamber (101) of the housing (10) to respectively abut against the two blades (50) so that the ends of the blades (50) located inside the chamber (101) keep pivoting toward the resilient member (30).

When the power plug of the present invention is connected with an electric wire (70), the electric wire (70) enters the chamber (101) through the wire inlet (102). Each terminal of the electric wire (70) is fastened on a corresponding fixing piece (42) by the screw (123). When the power plug is not inserted in a power socket, the ends of the two blades (50) inside the chamber (101) are not contacted with the contact pieces (41) of the spring leaves (40).

Figure 4:
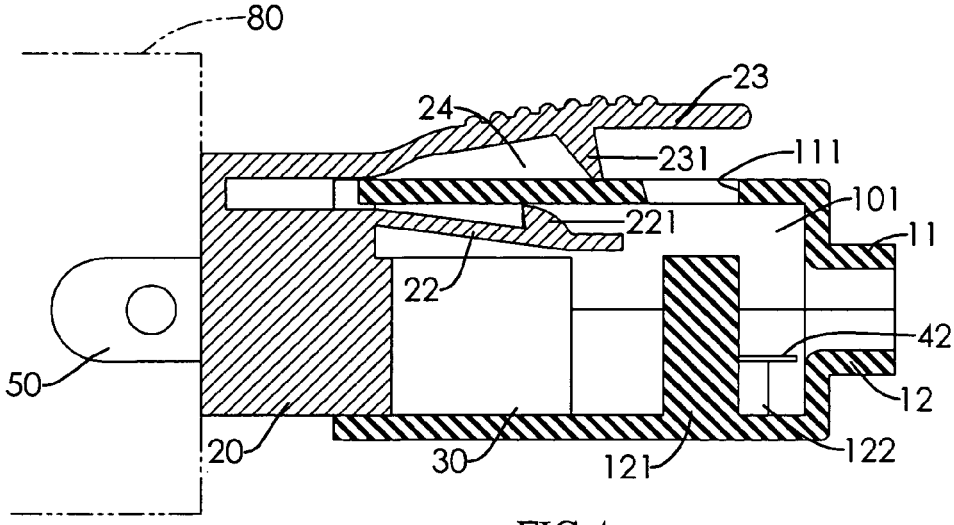
FIG. 4 is a first cross-sectional view of a power plug in accordance with the present invention when the power plug is inserted into a power socket.
Figure 6:
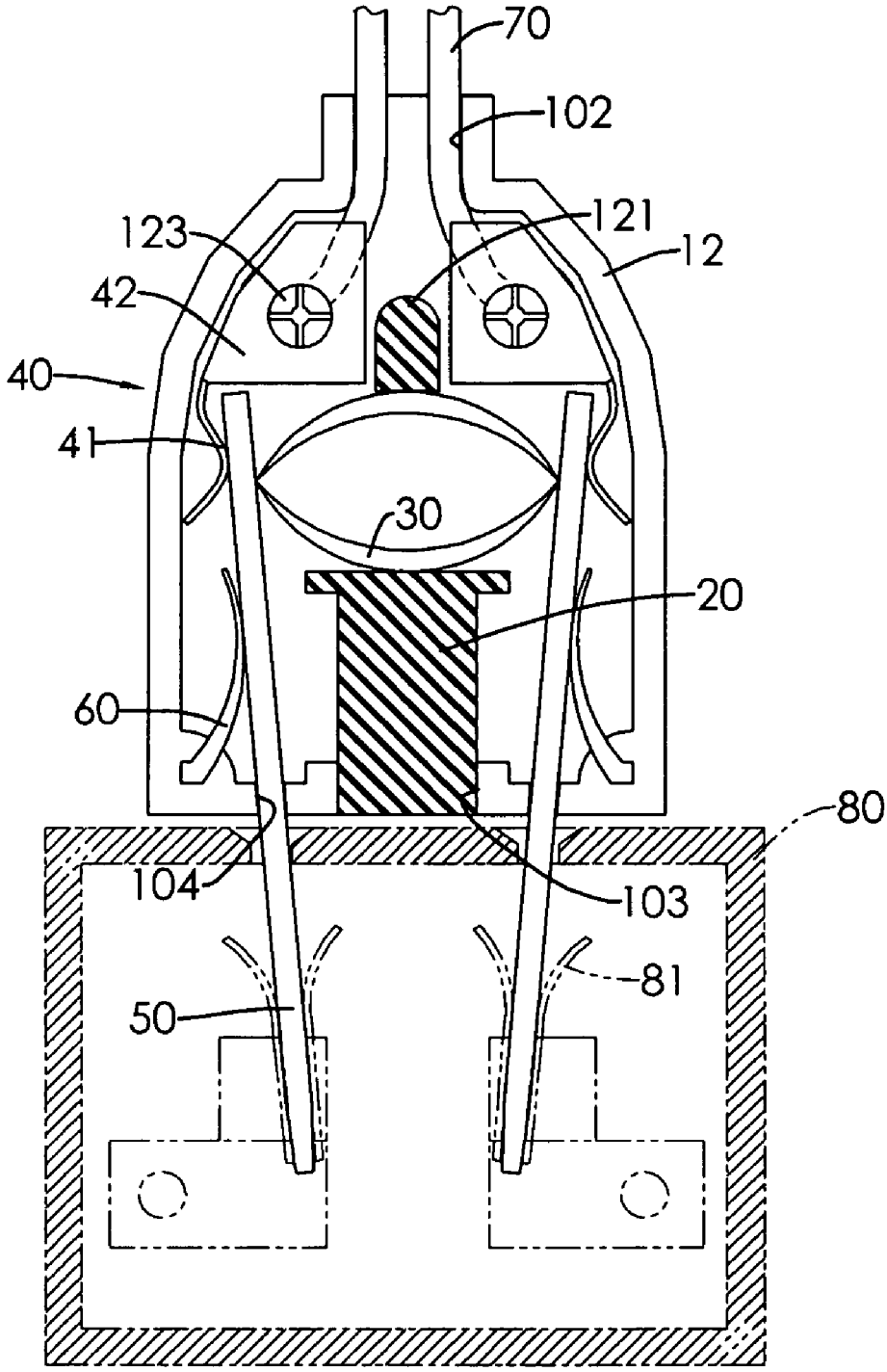
FIG. 6 is a third cross-sectional view of the power plug in accordance with the present invention when the power plug is inserted into a power socket.

With reference to FIGS. 4 to 6, when the power plug is inserted in a power socket (80), the slider (20) urges against the power socket (80) to move into the chamber (101). Hence, a periphery of the resilient member (30) is compressed by the limit plate (21) of the slider (20) and the stopper (121) inside the chamber (101) so that the resilient member (30) is deformed into an oval form. The top of the upper case (11) slides in the mouth (24) of the slider (20) and the engagement block (221) of the engagement tongue (22) engages with the engagement slot (111) of the upper case (11) so as to retain the slider (20) inside the chamber (101). Two protruded sides of the oval-like resilient member (30) respectively push the two blades (50) so that distal ends of the blades (50) inside the chamber (101) are pivoted to contact with the respective contact pieces (41). As a result, power can be conducted to the electric wire (70) through the blades (50) and the spring leaves (40). Moreover, when the ends of the two blades (50) inside the chamber (101) are pushed by the resilient member (30), the ends of the two blades (50) outside the chamber (101) are pivoted to close up so as to hold the power socket (80). Even after a holding force of the conductive strips (81) of the power socket (80) has been gradually reduced with use, the power plug is not easily disengaged.

Figure 7:
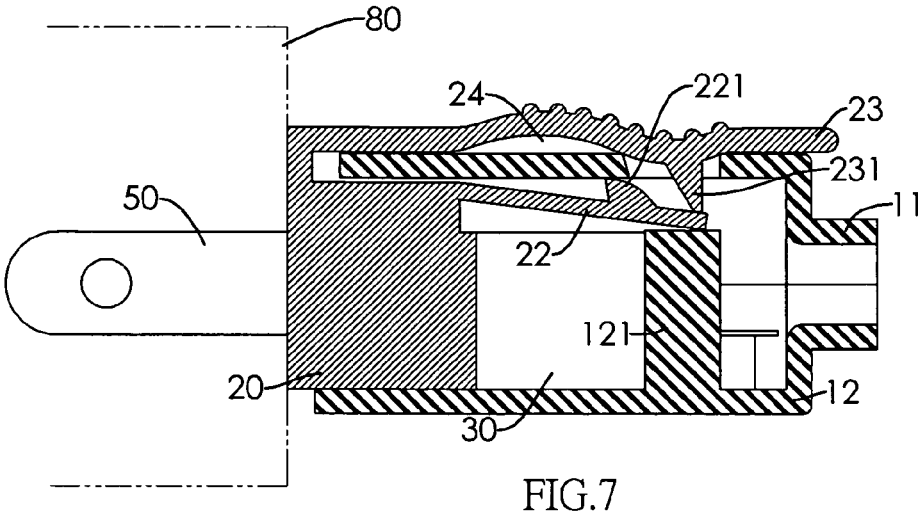
FIG. 7 is a fourth partial cross-sectional view of the power plug in accordance with the present invention when a release spring leaf is pressed and the power plug is unplugged.

With reference to FIG. 7, when the power plug is unplugged, the release tongue (23) is pressed first. By urging against a free end of the engagement tongue (22) through the urging finger (231), the engagement block (221) disengages from the engagement slot (111) and the top of the upper case (11) is pulled out of the mouth (24) of the slider (20). Then, the power plug is pulled to unplug. The resilient member (30) returns to an original cylindrical shape. The two blades (50) are respectively pushed against by the two restorable clips (60) to pivot to their original positions. The ends of the two blades (50) outside the chamber (101) no longer hold the power socket (80). The elastic force released by the resilient member (30) upon recovery of the original shape, acts on the stopper (121) inside the chamber (101) so that the housing (10) is moved away from the power socket (80). Then, the power plug is unplugged from the power socket (80). Accordingly, the present invention provides an effective lock that is easy to release.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A power plug, comprising:

a housing having an upper case;

a lower case mounted on the upper case to define a chamber;

a stopper mounted inside the chamber;

a wire inlet formed through a first side of the housing, communicating with the chamber, and abutting the stopper; and a slider opening formed through a second side of the housing opposite to the first side of the housing and communicating with the chamber;

a slider mounted through the slider opening, and having one end received in the chamber; and a limit plate formed on the end of the slider received in the chamber larger than the slide opening;

a cylindrical resilient member securely mounted on the limit plate, and located inside the chamber of the housing and between the stopper of the housing and the limit plate of the slider;

two spring leaves respectively mounted on two opposite positions of the lower case located inside the chamber and abutting the stopper;

two blades pivotally mounted to the housing, one end of each blade located inside the chamber and between the corresponding spring leaf and the resilient member, and respectively connected with and disconnected from the corresponding spring leaf when the blades are adapted to be plugged in and unplugged from a power socket; and two restorable clips respectively mounted on two opposite positions of the lower case and respectively abutting against the two blades to keep distal ends of the two blades inside the chamber pivoting toward the resilient member.

2. The power plug as claimed in claim 1, wherein the housing has two blade slots formed beside the slider opening; and the blades are respectively mounted in the two blade slots of the housing, each blade has a positioning channel abutting against the second side of the housing and an inner wall of the housing opposite to the second side, and a thickness of each blade is less than a width of the corresponding blade slot and a width of each positioning channel is more than a depth of the corresponding blade slot.

3. The power plug as claimed in claim 1, wherein the housing has two screw blocks mounted inside the chamber and abutting the wire inlet; and each spring leaf has a contact piece abutting the end of the corresponding blade inside the chamber; and a fixing piece connected with the contact piece, screwed to the corresponding screw block and fixed by a screw.

4. The power plug as claimed in claim 2, wherein the housing has two screw blocks mounted inside the chamber and abutting the wire inlet; and each spring leaf has a contact piece abutting the end of the corresponding blade inside the chamber; and a fixing piece connected with the contact piece, screwed to the corresponding screw block and fixed by a screw.

5. The power plug as claimed in claim 1, wherein the upper case has an engagement slot formed through a top of the upper case; and the slider has an engagement tongue formed on and extending from the end of the slider inside the chamber to the second side of the housing;

an engagement block formed on the engagement tongue and engaging with the engagement slot when the slider is moved inside the chamber;

a release tongue formed on and extending from one end of the slider outside the chamber to the second side of the housing, and located outside the upper case;

an urging finger mounted on the release tongue, and located above the engagement slot when the engagement block engages with the engagement slot; and a mouth formed in the slider and between the engagement tongue and the release tongue for the top of the upper case to be inserted therein.

6. The power plug as claimed in claim 2, wherein the upper case has an engagement slot formed through a top of the upper case; and the slider has an engagement tongue formed on and extending from the end of the slider inside the chamber to the second side of the housing;

an engagement block formed on the engagement tongue and engaging with the engagement slot when the slider is moved inside the chamber;

a release tongue formed on and extending from one end of the slider outside the chamber to the second side of the housing, and located outside the upper case;

an urging finger mounted on the release tongue, and located above the engagement slot when the engagement block engages with the engagement slot; and a mouth formed in the slider and between the engagement tongue and the release tongue for the top of the upper case to be inserted therein.

7. The power plug as claimed in claim 3, wherein the upper case has an engagement slot formed through a top of the upper case; and the slider has an engagement tongue formed on and extending from the end of the slider inside the chamber to the second side of the housing;

an engagement block formed on the engagement tongue and engaging with the engagement slot when the slider is moved inside the chamber;

a release tongue formed on and extending from one end of the slider outside the chamber to the second side of the housing, and located outside the upper case;

an urging finger mounted on the release tongue, and located above the engagement slot when the engagement block engages with the engagement slot; and a mouth formed in the slider and between the engagement tongue and the release tongue for the top of the upper case to be inserted therein.

8. The power plug as claimed in claim 4, wherein the upper case has an engagement slot formed through a top of the upper case; and the slider has an engagement tongue formed on and extending from the end of the slider inside the chamber to the second side of the housing;

an engagement block formed on the engagement tongue and engaging with the engagement slot when the slider is moved inside the chamber;

a release tongue formed on and extending from one end of the slider outside the chamber to the second side of the housing, and located outside the upper case;

an urging finger mounted on the release tongue, and located above the engagement slot when the engagement block engages with the engagement slot; and a mouth formed in the slider and between the engagement tongue and the release tongue for the top of the upper case to be inserted therein.

* * * * *